United States Patent [19]

Müller et al.

[11] Patent Number: 4,751,430

[45] Date of Patent: Jun. 14, 1988

[54] SPARK PLUG CONNECTOR HAVING TRANSFORMER, CAPACITOR, AND SPARK GAP

[75] Inventors: Helmut Müller, Ludwigsburg; Werner Niessner, Steinheim; Dieter Teutsch, Sachsenheim, all of Fed. Rep. of Germany

[73] Assignee: BERU Ruprecht GmbH & Co. KG, Ludwigsburg, Fed. Rep. of Germany

[21] Appl. No.: 942,291

[22] Filed: Dec. 16, 1986

[30] Foreign Application Priority Data

Dec. 18, 1985 [DE] Fed. Rep. of Germany ..... 3544870

[51] Int. Cl.[4] ..... H01T 13/04; H01R 13/66

[52] U.S. Cl. ..... 315/57; 315/58; 315/59; 315/62; 315/70; 315/71; 313/135; 313/123; 123/627; 123/634; 123/635; 123/654

[58] Field of Search ..... 123/169 R, 627, 634, 123/635, 647, 654; 315/56, 57, 58, 59, 62, 209 CD, 239, 70, 71; 313/123, 124, 135, 137

[56] References Cited

U.S. PATENT DOCUMENTS

| | | | |
|---|---|---|---|
| 3,995,183 | 11/1976 | Lechner et al. | 313/124 |
| 4,082,980 | 4/1978 | Yoshikawa et al. | 315/59 |
| 4,123,688 | 10/1978 | Yoshikawa et al. | 315/59 |
| 4,277,724 | 7/1981 | Beeghly | 315/57 |
| 4,514,712 | 4/1985 | McDougal | 123/634 X |

FOREIGN PATENT DOCUMENTS

| | | | |
|---|---|---|---|
| 1232399 | 1/1967 | Fed. Rep. of Germany | 315/58 |
| 0226279 | 12/1984 | Japan | 123/635 |

*Primary Examiner*—David K. Moore
*Assistant Examiner*—Mark R. Powell
*Attorney, Agent, or Firm*—Sixbey, Friedman & Leedom

[57] ABSTRACT

In a spark plug connector for a high-voltage distributorless high-voltage capacitor ignition system, comprising an ignition transformer and a storage capacitor connected on the secondary side to the ignition transformer, the spark plug connector is made rod-shaped with diameter dimensions corresponding to those of a spark plug and contains the storage capacitor and ignition transformer arranged one behind the other, the ignition transformer being disposed at the end of the spark plug connector remote from the spark plug connection.

10 Claims, 4 Drawing Sheets

SPARK PLUG CONNECTOR HAVING TRANSFORMER, CAPACITOR, AND SPARK GAP

The invention relates to a spark plug connector for a distributor-less high-voltage capacitor ignition system.

DE-AS No. 1,232,399 discloses a spark plug connector comprising a storage capacitor arranged coaxially about an ignition transformer which, in turn, coaxially surrounds a spark path formed with the voltage connection of the spark plug. This known spark plug connector, which is held by an adapter surrounding the spark plug, is disadvantageous insofar as it has a considerably large diameter and is, therefore, not suitable for arranging in the slim and deep plug holes of cylinder heads of modern engines, for instance, those having 3 or 4 valves per cylinder.

The object of the invention is, therefore, to further develop a spark plug connector of the above-mentioned type so that it can also be fitted directly onto a spark plug disposed deep in a spark plug hole.

Figure 1:
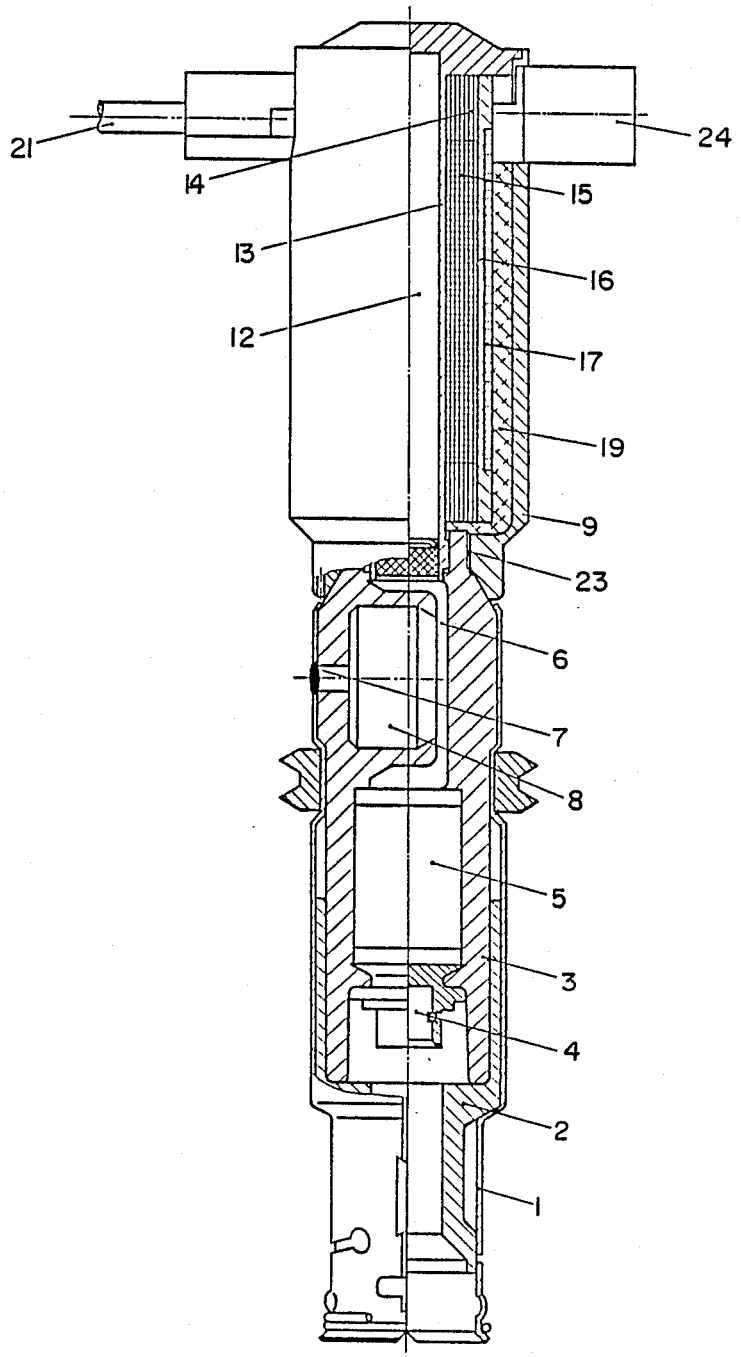
Figure 2:
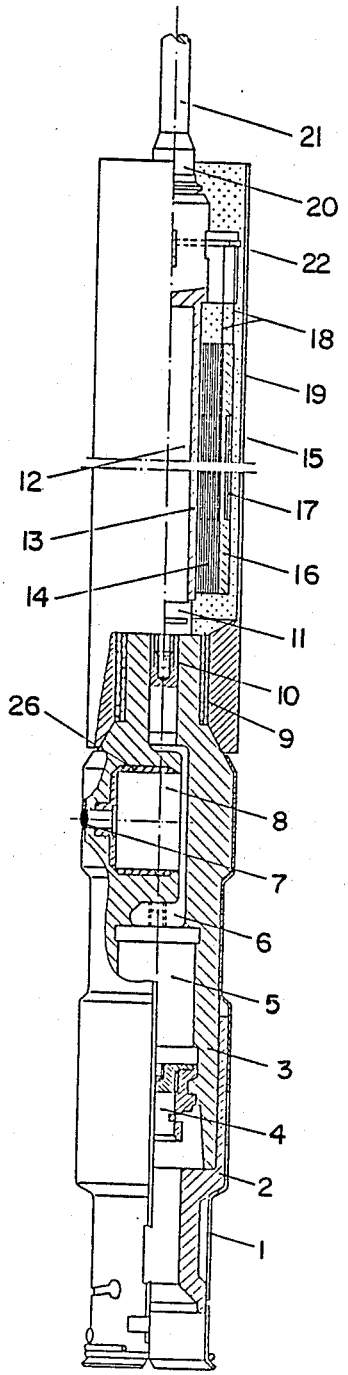
Figure 3:
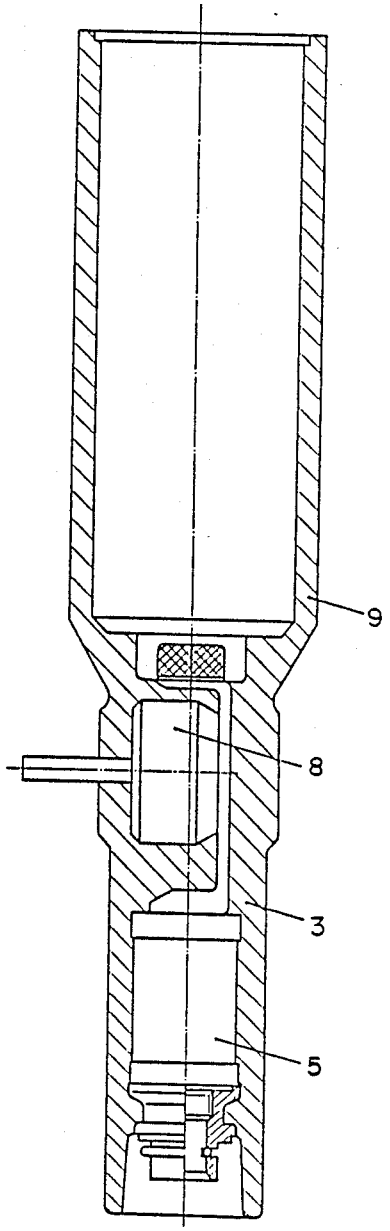
Figure 4:
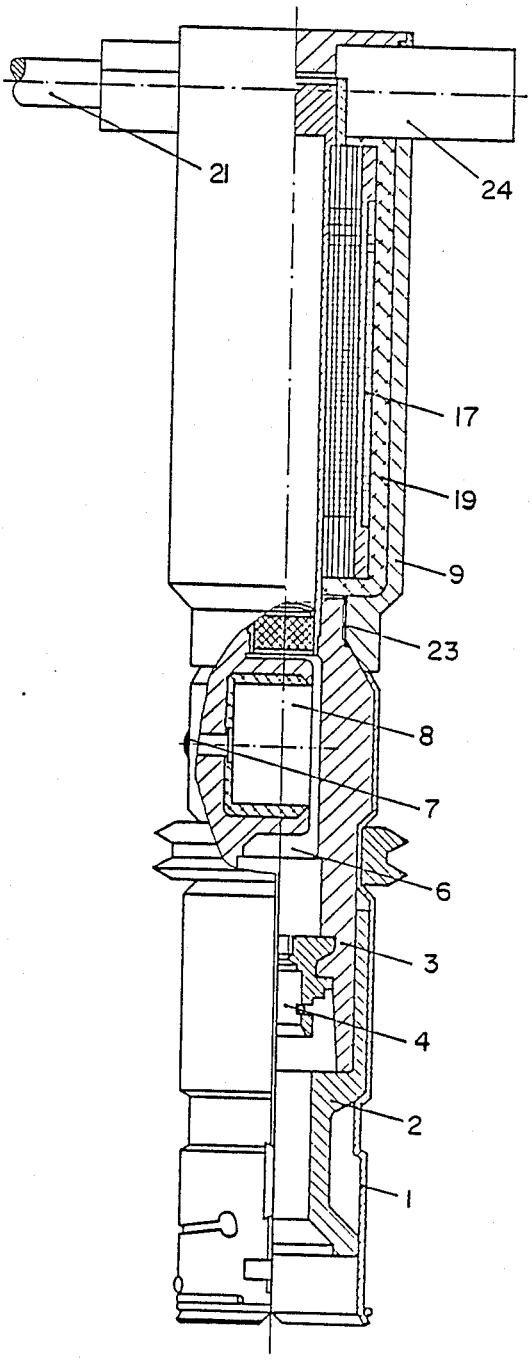

Embodiments of the invention will be described hereinafter with reference to the accompanying drawings, wherein:

FIG. 1 shows a first embodiment of the spark plug connector according to the invention in longitudinal section, FIG. 2 shows a second embodiment of the spark plug connector according to the invention in longitudinal section, FIG. 3 shows a third embodiment of the spark plug connector according to the invention in longitudinal section without ignition transformer and FIG. 4 shows a fourth embodiment of the spark plug connector according to the invention in longitudinal section.

The spark plug connector illustrated in FIG. 1 is made substantially cylindrical or rod-shaped and adapted in its diameter to the outer diameter of a spark plug and thus to the diameter of a spark plug hole. Outside the spark plug hole it also restricts itself substantially to the space above the cross-section.

The spark plug connector comprises, at its end remote from the spark plug, an ignition transformer comprising a ferrite core 12, a secondary winding 15 coaxially surrounding said ferrite core on a secondary coil body 13 and wound with layer insulation 14, and a primary winding 17 surrounding the secondary winding on a primary coil body 16. The secondary winding is thus advantageously arranged for the induced voltage within the primary winding. The spark plug connector further comprises a storage capacitor 8 constructed here as ceramic disc capacitor and a closed prespark path 5 which are arranged one behind the other, together with the ignition transformer, in the axial direction of the connector. One electrode of the prespark path 5 contacts, on the spark plug side, a connection socket 4 for the spark plug and, on the other side, is connected with one pole of the storage capacitor 8, via a contact member 6 that serves as an inner conductor. The contact member 6 is also in connection with the high-voltage end of the secondary winding 15 and in pressure contact with the ferrite core 12 via a metallic cap of the latter so that said core is also under high voltage.

The prespark path 5 and storage capacitor 8 are disposed in a surrounding injection molding 3 defining the form of the connector, and the ignition transformer is disposed in a coil housing 9 (that is formed of plastic and connected to the molding 3 by a threaded connection 23) and is cast therein by means of casting or sealing composition 19. The prespark paths and the capacitor 8 are formed as inserts within molding 3, having been embedded into the injection molding at the time that it was, itself, molded.

On the spark plug side, over the molding 3, there is an elastomeric protective flexible tube or introduction funnel 2. The protective tube 2 and molding 3 are surrounded by a sheet metal shield 1 intended, above all, to prevent radio interferences by irradiations from the prespark path 5. When the spark plug connector is placed onto the spark plug, the sheet metal shield 1 comes into contact with the hexagonal nut portion of the spark plug.

At 7 the ground pole of the storage capacitor is also connected to the sheet metal shield 1.

The electrical supply line 21, containing the voltage conductor for the primary winding and the ground conductor is connected to both the primary and the secondary windings, and is lead laterally into the coil housing through a grip 24. Grip 24 serves to facilitate withdrawal of the plug connector from the spark plug.

FIG. 2 shows a further embodiment of the spark plug connector. In this embodiment the contact member by itself, continues, as an axial rod 10, in the molding 3 in the direction towards the ignition tranformer. A thread is formed in the axial rod 10, into which is screwed a cap 11 of the ferrite core 12 that is provided with a screw-like extension, said cap being connected to the high-voltage end of the secondary winding 15.

The connection line 21, in this embodiment is introduced axially through a cable grommet 20. At 22, a solder pin can be seen to which the ground lead of the connection line 21 and ground connection wires 18 of the primary and secondary winding are connected.

The arrangement of the prespark path and storage capacitor 8 corresponds in this embodiment to that of FIG. 1 but with an insulation jacket 26 being provided on the capacitor 8.

FIG. 3 shows a version of the surrounding injection molding 3 (that defines the outer shape of the connector and which houses prespark gap 5 and storage capacitor 8) wherein, in this case, the coil housing 9 is formed as an integral extension of the molding 3.

FIG. 4 shows a spark plug connector embodiment without a prespark path, but which, otherwise, corresponds constructionally essentially to that of FIG. 1. This spark plug connector is shortened by the space otherwise required for the prespark path 5 and the contact member 6, in this case, is thus connected directly to the socket 4.

We claim:

1. A spark plug connector for a distributorless high-voltage capacitor ignition system, comprising an ignition transformer having a primary and a secondary coil, a storage capacitor which is connected on a secondary side to the ignition transformer, a closed spark gap, and a spark plug connection; wherein the spark plug connector is made rod-shaped of an outer diameter similar to a spark plug; wherein the spark plug connector contains the closed prespark path, the storage capacitor and ignition transformer axially arranged one behind the other in a body portion of the connector, the ignition transformer being disposed at an end of the spark plug connector remote from the spark plug connection; and wherein the body portion portion of the connector is formed by an injection molding in which the prespark path and the storage capacitor are inserts that were embedded into the injection molding at the time that it was molded, the prespark path and the storage capacitor being connected with an axial inner conductor which was likewise embedded in the injection molding when it was molded and to which a high-voltage end of the secondary coil is connected.

2. Spark plug connector according to claim 1, in which the secondary coil of the ignition transformer is disposed within the primary coil thereof and in which, in the secondary coil, a core is provided which is connected to the high-voltage end of the secondary coil.

3. Spark plug connector according to claim 2, in which the core is in pressure contact with the inner conductor.

4. Spark plug connector according to claim 3, in which the injection molding is surrounded by a sheet metal shield which, when the spark plug connector is fitted onto a spark plug, contacts the metal body thereof.

5. Spark plug connector according to claim 2, in which a screw contact is provided between the core and the inner conductor.

6. Spark plug connector according to claim 5, in which the injection molding is surrounded by a sheet metal shield which, when the spark plug connector is fitted onto a spark plug, contacts the metal body thereof.

7. Spark plug connector according to claim 5, in which one pole of the storage capacitor is connected to the sheet metal shield to establish a ground connection.

8. Spark plug connector according to claim 1, in which the injection molding is surrounded by a sheet metal shield which, when the spark plug connector is fitted onto a spark plug, contacts the metal body thereof.

9. Spark plug cconnector according to claim 1, in which the injection molding is surrounded by a sheet metal shield which, when the spark plug connector is fitted onto a spark plug, contacts the metal body thereof.

10. Spark plug connector according to claim 4, in which one pole of the storage capacitor is connected to the sheet metal shield to establish a ground connection.

* * * * *